US005940349A

United States Patent [19]

Stewart

[11] Patent Number: 5,940,349

[45] Date of Patent: Aug. 17, 1999

[54] WATCH WITH A FACE HAVING TACTILE PORTIONS FOR ACTIVATING FUNCTIONS

[76] Inventor: Michael A. Stewart, 22345 La Palma Ave. Unit 102, Yorba Linda, Calif. 92086

[21] Appl. No.: 08/803,525

[22] Filed: Feb. 20, 1997

[51] Int. Cl.[6] ..... G04C 7/00

[52] U.S. Cl. ..... 368/69; 368/281

[58] Field of Search ..... 368/69, 70, 281, 368/282

[56] References Cited

U.S. PATENT DOCUMENTS

| | | | |
|---|---|---|---|
| 3,767,875 | 10/1973 | Schneikart et al. | 368/69 |
| 3,803,834 | 4/1974 | Reese . | |
| 4,023,346 | 5/1977 | Kayser | 368/225 |
| 4,047,010 | 9/1977 | Perotto et al. . | |
| 4,059,956 | 11/1977 | Maeda et al. . | |
| 4,090,353 | 5/1978 | Maeda et al. . | |
| 4,244,044 | 1/1981 | Olsson . | |
| 4,630,935 | 12/1986 | Zettek | 368/41 |
| 4,769,797 | 9/1988 | Murakami | 368/111 |
| 5,418,760 | 5/1995 | Kawashima et al. | 368/69 |
| 5,453,960 | 9/1995 | Terés et al. . | |

FOREIGN PATENT DOCUMENTS

| | | | |
|---|---|---|---|
| 67815 | 3/1958 | France | 368/69 |
| 604261 | 8/1978 | Switzerland | 368/69 |

*Primary Examiner*—Bernard Roskoski

*Attorney, Agent, or Firm*—Kolisch, Hartwell, Dickinson, McCormack & Heuser

[57] ABSTRACT

A watch with a face disposed over a watch module with a display presenting a plurality of functions is described. The watch face preferably is rigid and transparent and includes tactile portions that may be depressed to activate the functions that are presented on the display. The watch face has four tactile portions to activate four primary functions. The watch face can also be pressed in between the tactile portions to activate a four secondary functions. In a preferred embodiment, the watch face is secured to the module and module is mounted at a central pivot point in a base. The watch module has switches on its edge, one beneath each tactile portion, and a flexible seal that creates a waterproof region around the switches. The flexible seal also includes knobs, one for each switch, which close the associated switch when the associated tactile portion is depressed. A platform prevents straight-down depression of the watch that could cause more than two switches to close. The watch also includes a bumper surrounding the perimeter of the watch face to fend of inadvertent depression of the tactile portions. In an alternative embodiment, the watch face is movably disposed over a watch module that is secured to the base. The watch face can pivot at a central gimbal point when depressed at a tactile portion to close switches on the edge of the watch module and a platform prevents straight-down depression. Another alternative includes a resilient, gel-like watch face that flows in response to depression at a tactile portion to close switches which activates watch functions.

25 Claims, 5 Drawing Sheets

WATCH WITH A FACE HAVING TACTILE PORTIONS FOR ACTIVATING FUNCTIONS

BACKGROUND AND SUMMARY OF THE INVENTION

The present invention relates generally to watches with variable displays and switches for controlling the display. More particularly, it concerns such a watch with a face over the display that has tactile portions that, when pressed, control or activate functions that are presented on the display. The invented watch makes use of the largest possible surface area on the watch, the face, for activating functions, while still leaving all of the face available as a display.

Watches with controllable displays are well known. These watches may display such functions as the present time, the present day and date, a timer with splits or lap times, or an alarm. The wearer controls the display and activates, i.e., sets, starts, and stops the various functions by pressing buttons arrayed around the watch on a side surface of a bezel surrounding the display. Typically these buttons are very small both in diameter and stroke, and may be recessed, making use difficult. This difficulty is compounded when the watch is on the wearer's wrist because use of the buttons on the bezel is interfered with by the wearer's hand, arm, and shirt cuff. Some watches with controllable displays incorporate larger buttons on an upper surface of the bezel but this sacrifices display space.

A watch with transparent touch electrodes on the face of the watch is disclosed in U.S. Pat. No. 4,090,353 to Maeda et al. A watch function is activated by placing a finger of one hand directly on one of the touch electrodes while the watch is worn on the wrist of the other hand. Because activation requires completion of an electrical circuit through the wearer's body, the watch only works while it is worn on the wrist and the electrode is directly contacted by the finger. Gloves or mittens must be removed to operate the watch. Also, the touch electrodes, which are small and close together, provide no tactile indication to the wearer that a fiction has been located and selected so the wearer must look at the watch to locate and select a function.

Another watch is disclosed in U.S. Pat. No. 4,244,044 to Olsson which describes a watch module enclosed in a case that includes a base and a transparent covering mounted over the module. The covering can be rotated in clockwise and counterclockwise directions to positions that correspond with watch functions. The covering can be depressed straight down, forcing a ball along an inclined ramp. The ball impacts a switch element closing a contact on the watch module which activates a watch function. The watch requires that the wearer grip the covering with one hand and rotate it. Unless the wearer is looking at the watch, or the wearer rotates the covering against a stop preventing further rotation, there is no way to determine which watch function will be activated when the covering is depressed. Also, only a single switch on the watch module may be activated at one time.

The watch face of the present invention preferably is mounted over a conventional watch module with a display that can present variable informative functions. The watch face includes tactile portions that a wearer can easily locate and discriminate by touching with their fingers. The wearer can then activate a watch function by depressing the watch face at one of the tactile portions. The portions may be made tactile by incorporating convex or concave areas on the watch face, or by providing any other texture or shape to identify the portion areas by touch. The watch face is supported and biased by springs or other resilient means to a neutral, central position where no switches are active. The springs return the watch face to the neutral position after depression when the wearer releases the tactile portion.

A significant advantage of the watch of the present invention is that the tactile portions, which can be transparent, are placed directly over the active part of the display. Thus, the size of the bezel surrounding the watch face where buttons are conventionally placed can be kept to a minimum while the active part of the watch display can be maximized.

Another appreciable advantage of the invention is that the wearer does not need to look at the watch to activate a watch function. This is advantageous if the wearer is engaged in a sport that makes looking at the watch difficult. With the watch of the present invention, the wearer can locate a watch function, for example, lap time, by touch, without actually activating the function, and then depress the watch at the tactile portion to activate the function. The wearer receives a positive indication that the desired function has been located by the texture or shape of the portion. The wearer also receives a positive indication that the function has been activated by the depression and return of the watch face. The wearer may then quickly glance at the display to check the lap time. The tactile portions on the invented watch can be large enough to be located by touch without sacrificing any watch display space.

A further advantage of the present invention is that a wearer who lacks effective control of the fingers can operate the watch nonetheless. The raised portions are large enough, and sufficiently distinct to be operated by the palm of the hand of a handicapped person or by a mitten-covered hand.

Another advantage of the invention is that it includes a bumper surrounding the face of the watch which protects against inadvertent activation of watch functions.

Yet another advantage of the invention is that it can be made waterproof and used in water sports. Such a watch may include indications for water depth and temperature which can be activated at a touch, giving the wearer the maximum amount of freedom to use his hands in the water sport.

A further advantage of the invention is that a conventional watch module with switches located on its sides may be used. These watch modules may include secondary functions that are activated when two of the switches are closed at the same time. The face of the invented watch may be depressed at a location between two of the tactile portions to close both switches and activate a secondary function. This is considerably easier than the conventional method of holding down two buttons, for example, with the thumb and forefinger.

These and additional objects and advantages of the present invention will be more readily understood after a consideration of the drawings and the detailed description of the preferred embodiment.

DETAILED DESCRIPTION OF THE PREFERRED AND ALTERNATE EMBODIMENTS

Figure 1:
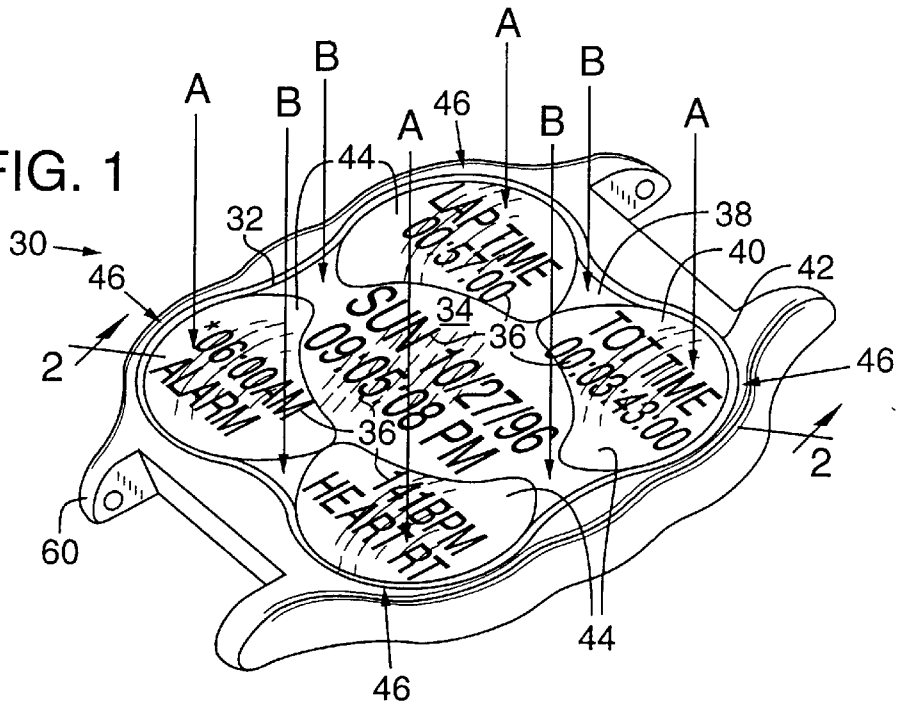
FIG. 1 is an enlarged isometric view of a watch according to the preferred embodiment of the present invention.

As shown in FIG. 1, a watch according to the present invention is generally indicated at 30. Watch 30 provides a useful, wearable watch with a controllable, multifunctional display capable of being worn by a wearer and controlled to display the functions that the wearer desires at any particular time.

FIG. 1 shows that watch 30 includes a watch module 32 having a display 34 which can present a plurality of watch functions 36 such as lap time, total time, etc. A watch face 38 is disposed over watch module 32 and is preferably a transparent lens which permits the wearer to see all of watch display 34. Watch face 38 includes an upper surface 40 defining a perimeter 42 and having a plurality of transparent, tactile portions 44, preferably four, spaced-apart on upper surface 40. The display presents the functions partly beneath the tactile portions and the functions are visible through the portions. The portions preferably are made tactile by their having a convex shape that is easily located and recognized by touch. However, the portions may also have a concave shape or be flat with textured areas, for example, a raised dot or dots, a roughened area, a raised bar or bars, or any other tactile indication. The portions may also be flat and non-textured and visually indicated, e.g., by a label on the face or display. The tactile portions are spaced apart from one another sufficiently to be independently operable by a wearer's finger.

The four tactile portions 44 preferably are spaced around the watch face every 90-degrees. The wearer can then easily activate a watch function using a finger by locating a tactile portion in one of four comers, indicated generally at 46, of the watch and operating the tactile portion by depressing it, as indicated by arrows A in FIG. 1. Comers will be understood as referring to spaced-apart locations for the tactile portions on a watch having a generally square, round, or any other suitable shape.

Figure 2:
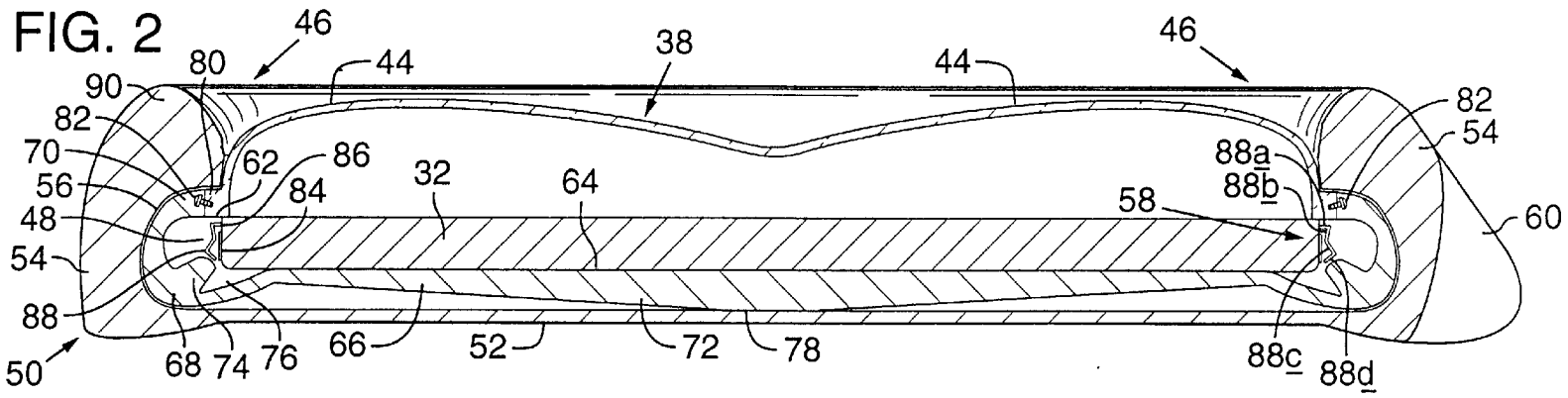
FIG. 2 is an enlarged sectional view taken on line 2—2 of FIG. 1.

FIG. 2 shows two switches 48 mounted on the watch module, but it will be understood that in this and other embodiments there are a plurality of switches, each switch located below one of tactile portions 44. The switches are normally open and are operable for activating watch functions. Depressing a tactile portion closes the switch below that tactile portion to activate a function. The watch, as illustrated, has four primary functions, each activated by an associated tactile portion. The watch module may include four secondary functions in addition to the primary functions which are activated by closing two adjacent switches. The wearer may cause two adjacent switches to be closed simultaneously by depressing the watch face in between two of the tactile portions as indicated by the arrows B in FIG. 1.

As shown in FIG. 2, the watch module is mounted in a base generally indicated at 50 which includes a bottom plate 52 supporting the watch module from beneath and a wall 54 surrounding the circumference of the watch module. The base includes a circumferential groove 56 in wall 54 for receiving an edge, generally indicated at 58, of the watch module around the circumference of the watch module. The base includes ears 60 for connecting the watch to a conventional wrist band, not shown.

In the preferred embodiment, watch face 38 is formed of a rigid material and includes a lower edge 62 on its perimeter that is secured to the watch module around the edge of the display by conventional means such as an adhesive sealant. The watch module has a bottom 64 opposite the display where a flexible seal 66 is disposed having an outer support ring 68, a sealing lip 70, a raised platform 72 and a plurality of switch-closing knobs 74, one for each switch 48. Seal 66 creates a waterproof region 76 surrounding watch module 32 and watch face 38, enclosing switches 48. Watch module 32 and watch face 38 are movable relative to the base because the watch module is supported at a central gimbal point 78 by platform 72 which permits the module and attached watch face to be centrally pivotal relative to base 50. Flexible seal 66 is joined at sealing lip 70 to a flange 80 on the watch face by screws 82. If the connection between watch face 38 and watch module 32 is waterproof, then sealing lip 70 may instead be joined to watch module 32 below watch face 38.

Figure 3:
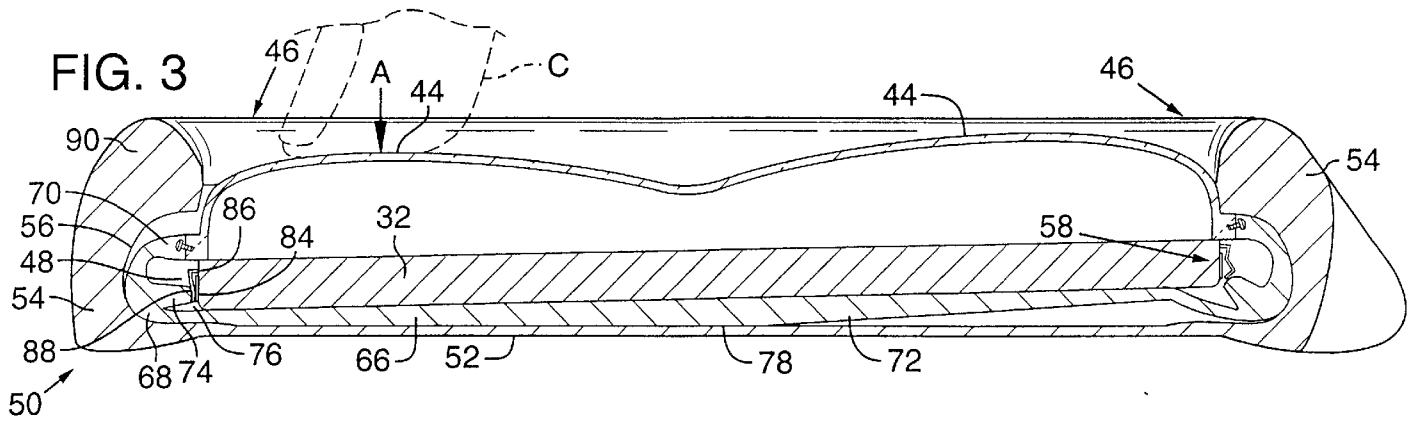
FIG. 3 is an enlarged sectional view similar to FIG. 2 with the watch face depressed at a tactile portion to activate a switch.

As shown in FIG. 3, watch face 38 can be depressed at each of tactile portions 44 as indicated by arrow A. When tactile portion 44 is depressed, watch module 32 pivots at its central gimbal point 78. Platform 72 prevents the watch module from being depressed straight down at central gimbal point 78 which could result in simultaneous closures of more than two switches.

As shown in FIGS. 2 and 3, each switch 48 includes a contact 84 and an anchor 86, both mounted on watch module 32, and a knob-contacting, zigzag-shaped leaf 88 depending from anchor 86 and biased away from contact 84. The leaf is made of four sections: a first section 88*a* extending perpendicularly from the edge of the watch module at the switch anchor, a second section 88*b* depending inwardly and downwardly from the first section, a third section 88*c* depending outwardly and downwardly from the second section, and a fourth section 88*d* depending inwardly and downwardly from the third section. The third and fourth sections are adjacent the switch contact. Each knob 74 is disposed beneath and to the outside of the fourth section of an associated knob-contacting leaf 88 and is pointed up at the fourth section at about a 45-degree angle. The fourth section is roughly perpendicular to the angle of the knob. When watch module 32 is partially depressed by the wearer's finger C, fourth section 88*d* of leaf 88 is pushed into contact with knob 74. As watch module 32 is depressed further, knob 74 is pushed by leaf 88, which in turn straightens out at the joint between the third and fourth sections which press against contact 84 to close switch 48. Outer support ring 68 compresses in response to depression of watch module 32 and when the wearer releases tactile portion 44, watch module 32 returns to the neutral position with knob 74 rotating back to its original position, allowing switch 48 to open.

When the watch face is depressed in between two tactile portions, as shown by arrows B in FIG. 1, the two switches associated with the two tactile portions pivot downwardly. This causes both associated switches to close simultaneously because leaves 88 on both switches are pressed into associated knobs 74, activating a secondary watch function. When the watch face is released, the outer support ring returns the watch module to the neutral position.

As shown in FIG. 2, the watch also includes a raised bumper 90 atop wall 54 of the base surrounding perimeter 42 of watch face 38. Bumper 90 is at least about as high as tactile portions 44 on watch face 38. Bumper 90 prevents inadvertent activation of switches 48 when watch face 38 is accidentally bumped. For example, the wearer running in a pack of runners in a race may be bumped on the watch by an arm of another runner. The bumper fends off the arm, preventing the arm from depressing a tactile portion on the watch face. The bumper may be included in any of the embodiments of the invention.

Figure 4:
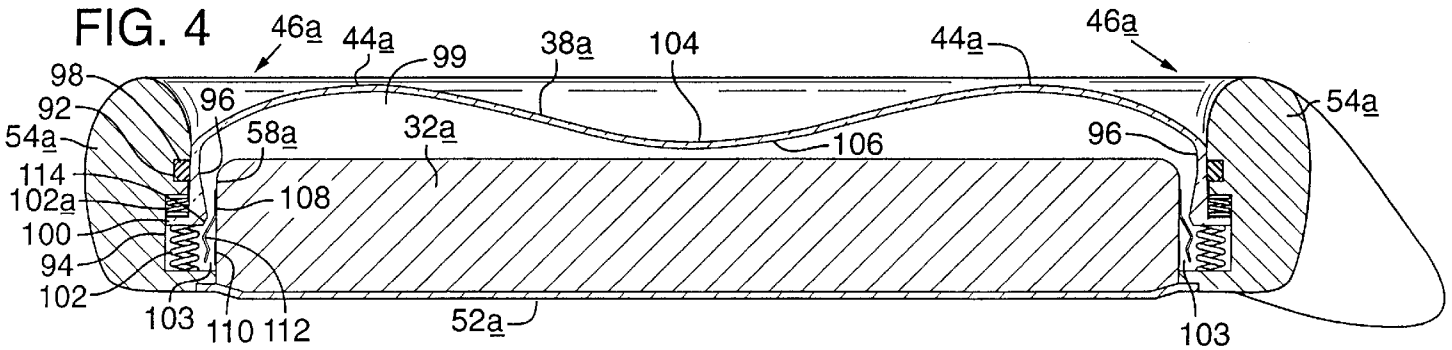
FIG. 4 is an enlarged sectional view similar to FIG. 2 showing another embodiment of the invention with the watch face movable relative to the watch module.
Figure 5:
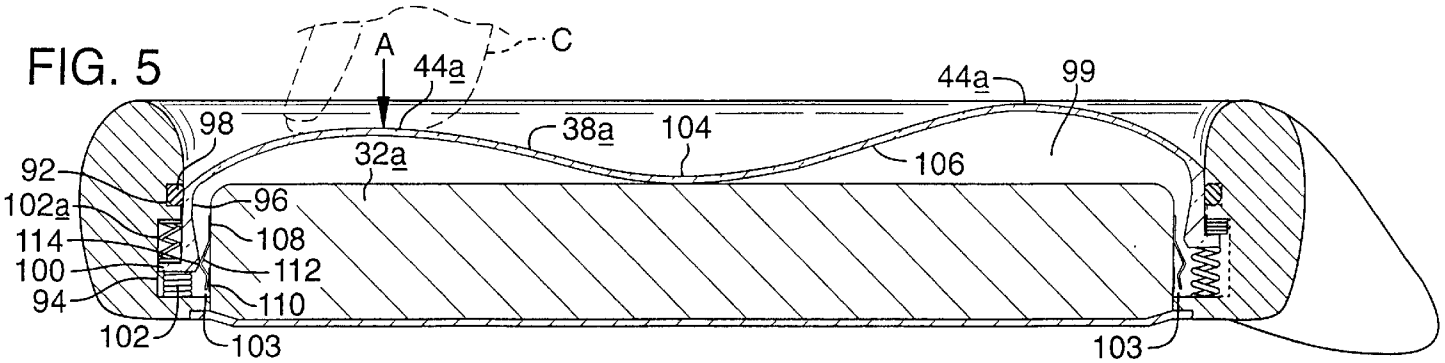
FIG. 5 is an enlarged sectional view similar to FIG. 4 with the watch face depressed at a tactile portion to activate a switch.

An alternative embodiment of watch 30 is shown in FIGS. 4 and 5. In this embodiment, a watch module 32*a* is secured to a base plate 52*a* and a watch face 38*a* is movably disposed over a watch module 32*a*. A base wall 54*a* includes a circumferential notch 92 and a circumferential channel 94. Watch face 38*a* includes four transparent, tactile portions 44*a* located in corners, indicated generally at 46*a*, similar to the preferred embodiment. The watch face also includes a skirt 96 that overhangs watch module 32*a* between an edge 58*a* of the watch module and base wall 54*a*. An O-ring 98 is disposed in notch 92 and is in slideable, waterproof contact with skirt 96 around the skirt's circumference creating a waterproof region 99 defined by the watch face and the base, enclosing the watch module.

As shown in FIGS. 4 and 5, watch face 38*a* includes a flange 100 on the bottom of skirt 96. Flange 100 is received in channel 94 and is biased midway in the channel by springs 102 below the flange and springs 102*a* above the flange. The springs are preferably disposed adjacent switches 103. As seen in FIG. 5, the watch face pivots centrally relative to the base about a gimbal point 104 when depressed at a tactile portion 44*a* as indicated by arrow A. A platform 106, formed as part of watch face 38*a*, prevents watch face 38*a* from being completely depressed straight down at its center which could result in simultaneous closing of more than two switches 103. Alternatively, the platform may be formed on the watch module below the central gimbal point of the face.

FIGS. 4 and 5 show two switches 103, each located below an associated tactile portion 44*a*. It will be understood that this embodiment includes four switches, one below each tactile portion. Each switch includes an anchor 108 and a contact 110 mounted on watch module 32*a*, and a leaf element 112 depending from anchor 108 and nominally biased away from contact 110. Skirt 96 includes a plurality of leaf-contacting nubs 114 disposed at the bottom end of skirt 96, each one below an associated tactile portion 44*a* and just above an associated leaf 112. When watch face 38*a* is depressed at a tactile portion 44*a* by the wearer's finger C, associated nub 114 impacts leaf 112 and presses leaf 112 against contact 110, closing switch 103. While watch face 38*a* is depressed, as seen in FIG. 5, associated spring 102 is compressed and when released, spring 102 expands to return watch face 38*a* to its neutral position reopening the switch, as seen in FIG. 4.

When the watch face is depressed in between two tactile portions, as shown by arrows B in FIG. 1, the two nubs associated with the two tactile portions pivot downwardly, contacting the associated switch leaves. This causes both associated switches 103 to be closed simultaneously, activating a secondary watch function. When the watch face is released, springs 102 return the watch face to the neutral position.

Figure 6:
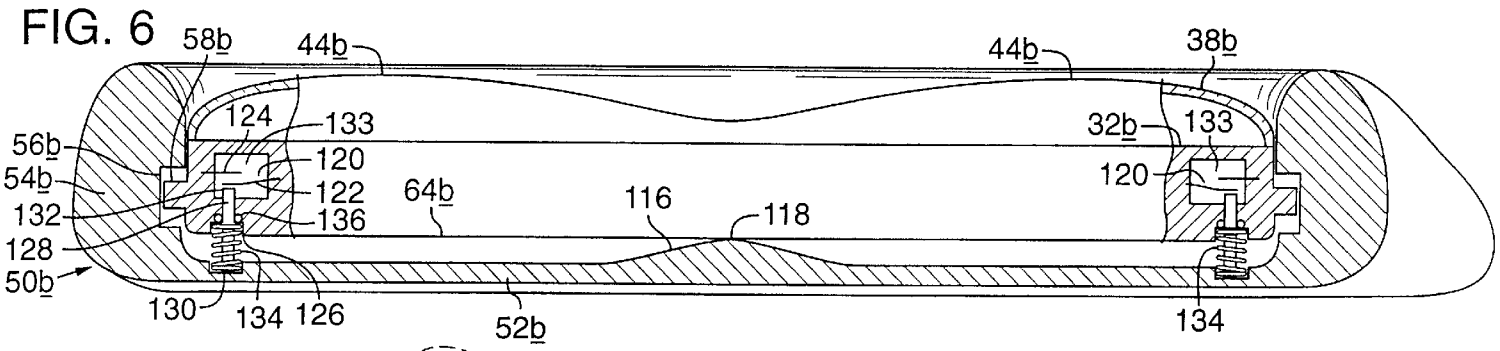
FIG. 6 is an enlarged sectional view similar to FIG. 2 showing another embodiment of the invention with the watch face fixed on the watch module.
Figure 7:
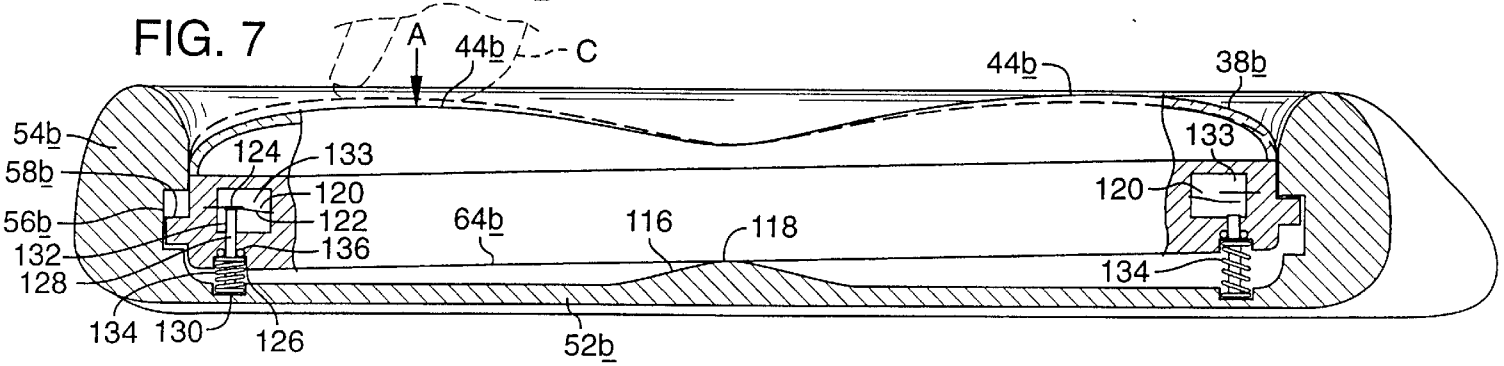
FIG. 7 is an enlarged sectional view similar to FIG. 6 with the watch face depressed at a tactile portion to activate a switch.

Another embodiment of the invention is shown in FIGS. 6 and 7. A watch module 32*b* and a watch face 38*b* are secured together in a waterproof fashion. The watch module is disposed in a base 50*b* with a bottom 64*b* of the module placed over a base plate 52*b*. The base includes a wall 54*b* with a circumferential groove 56*b* for receiving an edge 58*b* of the module or watch face. Since module 32*b* and face 38*b* are secured together, an edge of either may be held by the groove. Base 50*b* has a platform 116 rising from base plate 52*b* that supports watch module 32*b* at a central gimbal point 118 permitting module 32*b* and attached face 38*b* to pivot centrally relative to the base. Two switches 120 are shown in FIGS. 6 and 7 disposed within watch module 32*b*, one below each tactile portion but it will be understood that the watch module includes four switches, each below an associated tactile portion 44*b*. Each switch 120 includes a leaf element 122 and a contact 124.

The watch module includes a plurality of apertures 126, one below each switch 120 and a plurality of vertical, nonconductive pins 128, one extending through each aperture 126. Each pin is secured at one end 130 in base plate 52*b*. The other end 132 of each pin 128 is just below leaf 122 of associated switch 120. Watch module 32*b* is biased to a central, neutral position by a plurality of springs 134, each disposed adjacent one of pins 128. A plurality of O-rings 136, one for each aperture, create a waterproof region 133 surrounding the switches within the watch module. Each pin 128 is surrounded at aperture 126 by one of O-rings 136, preventing water from entering watch module 32*b*.

As seen in FIGS. 6 and 7, watch face 38*b* may be depressed by the wearer's finger C at a tactile portion 44*b*, as indicated by arrow A. Watch module 32*b* which is secured to the watch face pivots about central gimbal point 118. Platform 116 prevents watch module 32*b* from being depressed straight down. As watch face 38*b* is depressed at a tactile portion 44*b*, associated pin 128 and leaf 122 remain stationary while contact 124 is pressed against leaf 122, closing switch 120. Associated spring 134 compresses when watch face 38*b* is depressed and expands when watch face 38*b* is released to return the watch face and module to the neutral position, reopening switch 120.

When the watch face is depressed in between two tactile portions, as shown by arrows B in FIG. 1, the two switch contacts associated with the two tactile portions pivot downwardly, contacting the associated switch leaves. This causes both associated switches 120 to be closed simultaneously, activating a secondary watch function. When the watch face is released, springs 134 return the watch module to the neutral position.

Figure 9:
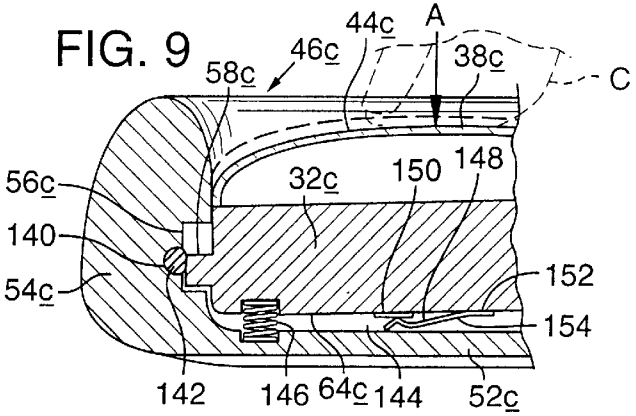
FIG. 9 is an enlarged sectional view similar to FIG. 8 with the watch face depressed at a tactile portion to activate a switch.
Figure 8:
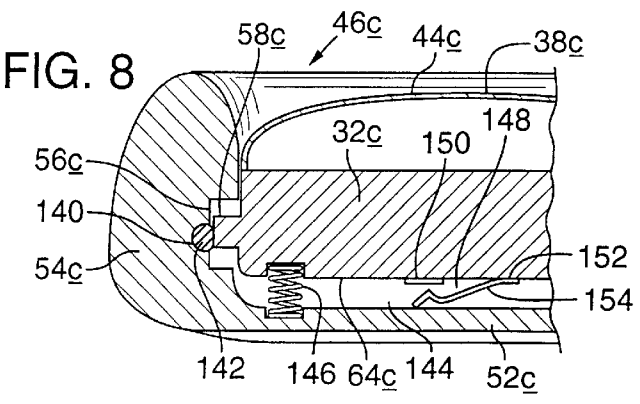
FIG. 8 is a further enlarged sectional view similar to FIG. 2 showing another embodiment of the invention with the watch module enclosed in a waterproof base.

A different embodiment of the switches and waterproofing is shown in FIGS. 8 and 9. A groove 56*c* in a base wall 54*c* further includes a circumferential notch 140 holding an O-ring 142. An edge 58*c* of a watch module 32*c* is slidably engaged by the O-ring, creating a waterproof region 144 defined by a base plate 52*c*, base wall 54*c* up to notch 140, and a bottom 64*c* of watch module 32*c*. Within region 144, a plurality of springs 146 bias watch module 32*c* to a central neutral position. A switch 148 is shown in FIGS. 8 and 9, but it will be understood that the watch includes four switches disposed on bottom 64*c* of watch module 32*c*, one below each of four tactile portions 44*c* located in comers indicated generally at 46*c*. Each switch has a contact 150, an anchor 152, and a leaf 154 extending from anchor 152 and biased away from contact 150.

As seen in FIG. 9, when watch face 38*c* is depressed at a tactile portion 44*c*, contact 150 of associated switch 148 is driven against associated leaf 154 which is held in place by base plate 52*c*. Associated spring 146 compresses when face 38*c* is depressed and expands when watch face 38*c* is released to return watch face 38*c* to its neutral position, reopening switch 148. In an alternative embodiment, springs 146 may be eliminated and leaves 154 may provide the necessary biasing of watch module 32*c*.

Figure 10:
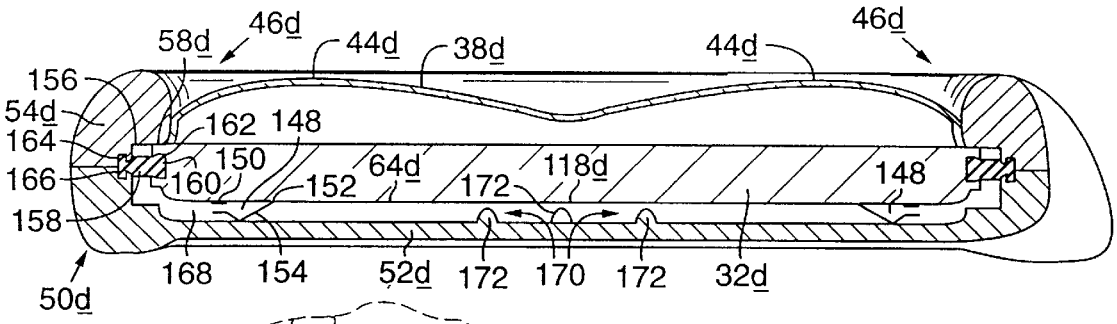
FIG. 10 is an enlarged sectional view similar to FIG. 2 showing another embodiment of the invention with the watch module enclosed in a waterproof base.
Figure 11:
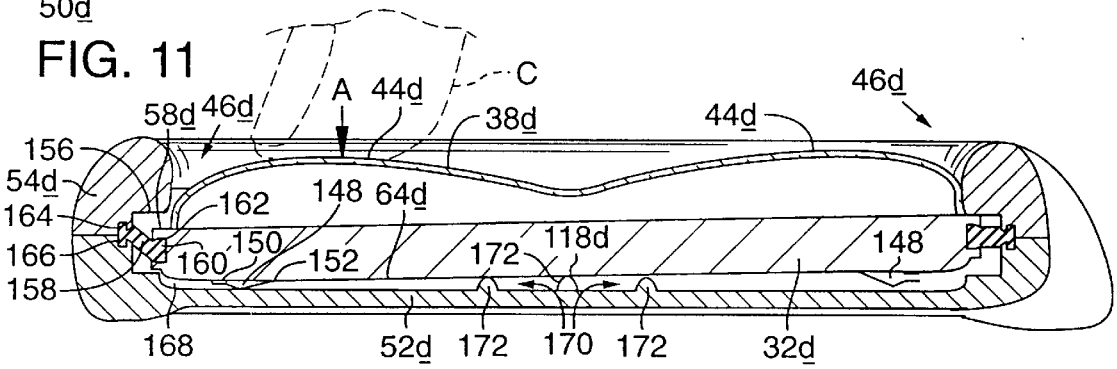
FIG. 11 is an enlarged sectional view similar to FIG. 10 with the watch face depressed at a tactile portion to activate a switch.

Another embodiment of the invention, shown in FIGS. 10 and 11, includes a different waterproofing and biasing arrangement. In this embodiment a watch module 32*d* and a watch face 38*d* are secured together and placed in a base 50*d*. A base wall 54*d* includes a circumferential channel 156 which confines an edge 58*d* of watch module 32*d* or face 38*d*. A flexible gasket 158 surrounds watch module 32*d* and has an inner bead 160 clamped in a circumferential binding 162 extending along edge 58*d* of watch module 32*d*. Channel 156 includes a circumferential clasp 164 that holds an outer bead 166 of gasket 158 creating a waterproof region 168 defined by base plate 521*d*, base wall 54*d* up to clasp 164, flexible gasket 158 and a bottom 64*d* of watch module 32*d*. Flexible gasket 158 biases watch module 32*d* to a central neutral position within the base. Two switches 148 are shown in FIGS. 10 and 11 but it will be understood that there are four switches 148 disposed on bottom 64*d* of watch module 32*d*, one below each of four tactile portions 44*d*, each switch having a contact 150, an anchor 152, and a leaf 154 extending from anchor 152 and biased away from contact 150.

As seen in FIG. 11, when watch face 38*d* is depressed at a tactile portion 44*d* contact 150 of associated switch 148 is driven against associated leaf 154 which is held in place by base plate 52*d*, closing switch 148. Flexible gasket 158 is stretched, when watch face 38*d* is depressed, and retracts, when watch face 38*d* is released, to return watch face 38*d* to its neutral position, reopening switch 148. FIG. 11 also shows that a platform, indicated generally at 170, may be provided by raised dots 172 in base plate 52*d* which permit watch face 38*d* to be depressed at a tactile portion 44*d* and pivot centrally at a gimbal point 118 but prevent it from being depressed straight down.

When the watch face is depressed in between two tactile portions, as shown by arrows B in FIG. 1, the two switch contacts associated with the two tactile portions pivot downwardly, contacting the associated switch leaves. This causes both associated switches 148 to be closed simultaneously, activating a secondary watch function. When the watch face is released, flexible gasket 158 returns the watch module to the neutral position.

Figure 12:
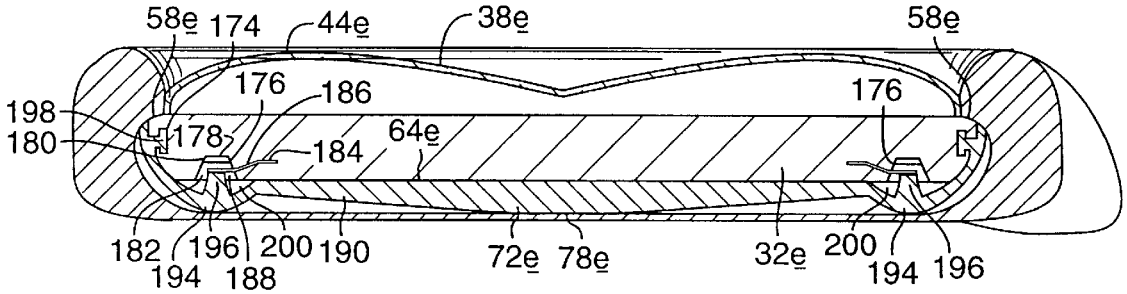
FIG. 12 is an enlarged sectional view similar to FIG. 2 showing another embodiment of the invention with the bottom and sides of the watch module enclosed in a flexible, waterproof seal.
Figure 13:
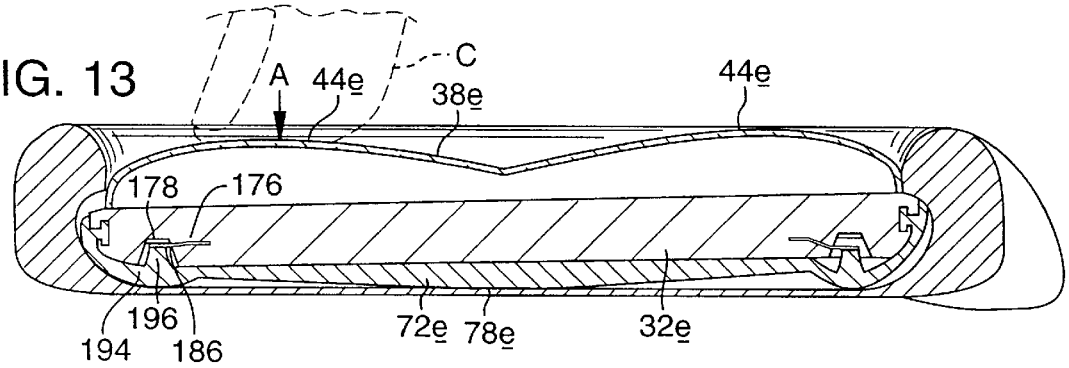
FIG. 13 is an enlarged sectional view similar to FIG. 12 with the watch face depressed at a tactile portion to activate a switch.

Another embodiment of the invention is shown in FIGS. 12 and 13 where a watch module 32*e* includes a circumferential clamp 174 around an edge 58*e* and a plurality of switches 176 adjacent a bottom 64*e* of a watch module 32*e*, each switch including a contact 178 disposed at an upper end 180 of a cavity 182, an anchor 184, and a leaf 186 extending from anchor 184, nominally biased at a lower end 188 of cavity 182. Two switches 176 are shown in FIGS. 12 and 13 but it will be understood that there are four switches in this embodiment, one beneath each of four tactile portions 44*e*. A flexible seal 190 which includes a platform 72*e*, a biasing ring 194, a plurality of switch-contacting nodules 196, and a sealing lip 198, encloses bottom 64*e* and edge 58*e* of watch module 32*e* with the sealing lip held by circumferential clamp 174. The biasing ring resiliently supports the watch module and biases the watch module at a central position with the switches open. Platform 72*e* supports watch module 32*e* at central gimbal point 78*e*. Each of nodules 196 are disposed just below an associated leaf 186 at lower end 188 of a cavity 182. A waterproof region 200 which encloses switches 176 is created between flexible seal 190 and bottom 64*e* of the watch module.

As seen in FIG. 13, when watch face 38*e* is depressed by wearer's finger C at a tactile portion 44*e*, associated contact 178 is driven against leaf 186 which is held in place by nodule 196, closing switch 176. When watch face 38*e* is depressed at a tactile portion 44*e* biasing ring 194 is compressed below that tactile portion 44*e* and when watch face 38*e* is released, ring 194 expands to return the watch face and module to the central position, reopening switch 176. Platform 72*e* permits watch face 38*e* to be depressed at a tactile portion 44*e* and pivot centrally at a gimbal point 78*e* but prevents the watch face from being depressed straight down.

When the watch face is depressed in between two tactile portions, as shown by arrows B in FIG. 1, the two switch contacts associated with the two tactile portions pivot downwardly, contacting the associated switch leaves. This causes both associated switches 176 to be closed simultaneously, activating a secondary watch function. When the watch face is released, biasing ring 194 returns the watch module to the neutral position.

Figure 14:
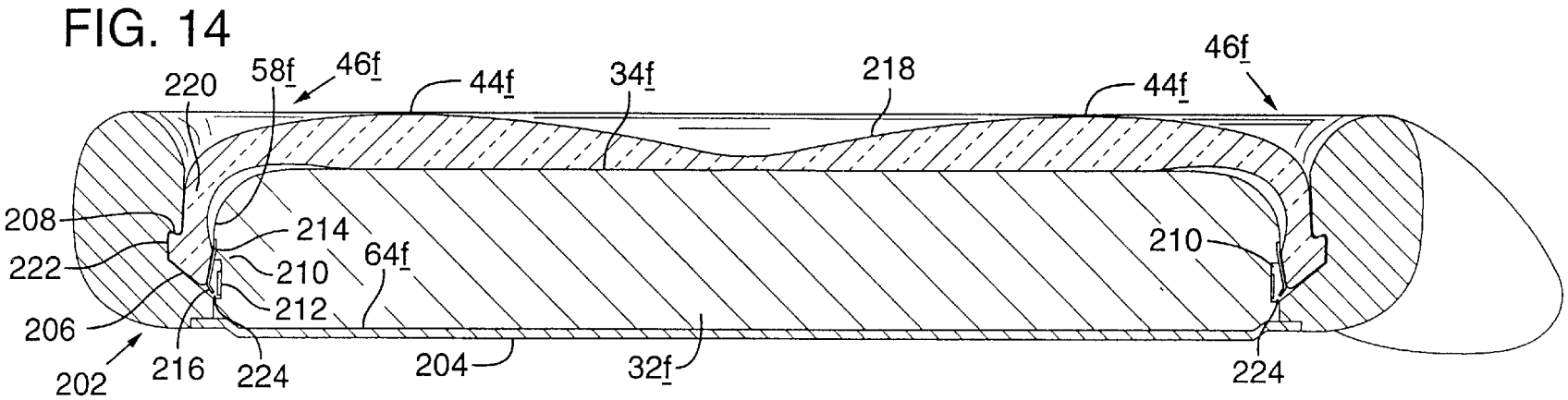
FIG. 14 is an enlarged sectional view similar to FIG. 2 showing another embodiment of the invention with a resilient, transparent watch face.
Figure 15:
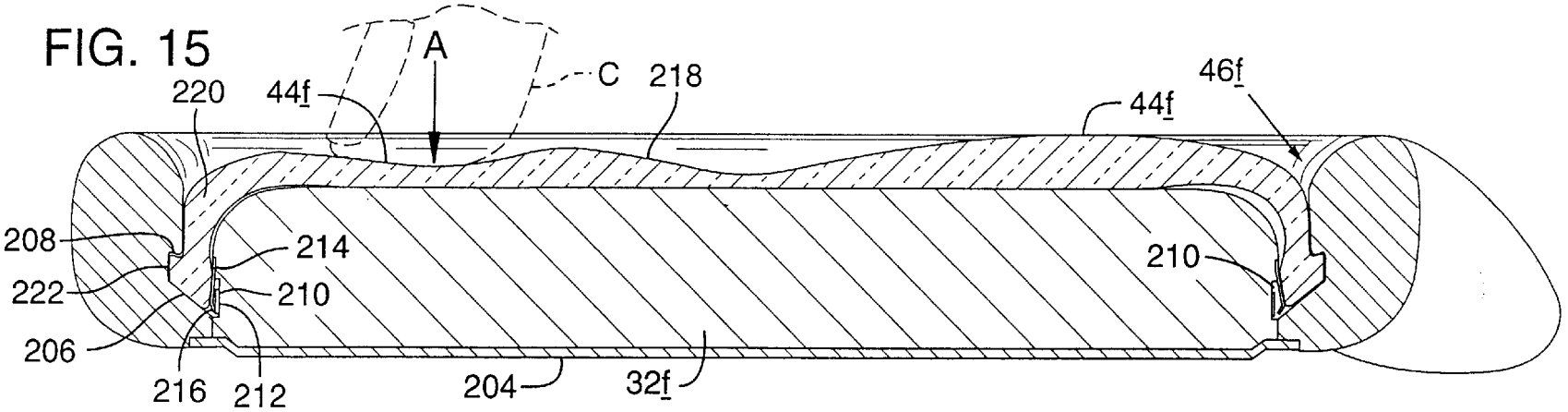
FIG. 15 is an enlarged sectional view similar to FIG. 14 with the watch face depressed at a tactile portion to activate a switch.

Another embodiment of the invention is shown in FIGS. 14 and 15 where a bottom 64*f* of a watch module 32*f* is secured to a base 202 at a plate 204. Base 202 includes a circumferential inner wall 206 extending upwardly from plate 204, alongside an edge 58*f* of watch module 32*f*, and sloping away from edge 58*f*. Above wall 206 is a circumferential hook 208. A plurality of switches 210 are included on edge 58*f* of watch module 32*f*, one at each comer 46*f*, each switch 210 having a contact 212, an anchor 214, and a leaf 216 depending from anchor 214 and biased away from contact 212. Although only two switches 210 are shown in FIGS. 14 and 15, it will be understood that this embodiment includes four switches 210. Watch face 218 is made of a resilient, gel-like, transparent material and is disposed over watch display 34*f*. Watch face 218 includes a plurality of transparent tactile portions 44*f* one above each switch. The watch face also includes a skirt 220 that overhangs edges 58*f* of watch module 32*f* between watch module 32*f* and base wall 206. Skirt 220 includes an outer flange 222 that is held by circumferential hook 208. The watch face encloses the switches in a waterproof region 224 defined by skirt 220, edge 58f of the watch module and base wall 206.

As best seen in FIG. 14, skirt 220 nominally fills the area between base wall 206 and leaf 216. As seen in FIG. 15, when watch face 218 is depressed at a tactile portion 44*f*, as indicated by arrow A, the gel-like material is forced to flow away from tactile portion 44*f*. Skirt 220 in the area around the tactile portion expands in response to this flow. The expanded skirt, as seen in FIG. 15, pushes leaf 216 against contact 212, closing switch 210. When tactile portion 44f is released, the gel-like material returns to its nominal state, reopening switch 210.

The watch module in any of the embodiments may delay for a bounce time in response to detection of a switch closing. The bounce time prevents the activation of a function 36 when a tactile portion 44 is depressed inadvertently for just a moment and also prevents repeated activation and deactivation of a function that would otherwise occur as the switch bounces mechanically as it is closed.

The movable tactile portions and switches of the watch could also be replaced by transparent touch electrodes mounted on the watch face. The touch electrodes would preferably be made tactile, either by incorporating a concave or convex area on the watch face under the electrode or by providing other texture in at or near the touch electrode. The wearer operates the touch electrodes to activate a watch function by touching the electrode with a finger. The touch electrodes are integrated with the watch module in a manner well known in the art.

While the present invention has been shown and described with reference to the foregoing preferred and alternate embodiments, it is to be understood by those skilled in the art that other changes in form and detail may be made therein without departing from the spirit and scope of the invention as defined in the appended claims.

I claim:

1. A watch comprising:

a watch module having a display and a plurality of watch functions which the display can present;

a watch face with an upper surface, the face disposed over the display of the watch module, the upper surface having a plurality of tactile portion spaced apart sufficiently to be independently operable by a wearer's finger;

a plurality of switches coupled to the watch module operable for activating the watch functions when the tactile portions are depressed by the wearer's finger.

2. The watch of claim 1 further comprising a base which supports the watch module and wherein the watch face is formed of a rigid material and is movable relative to the base.

3. The watch of claim 2 wherein the watch face is secured to the watch module and the watch module is movable relative to the base.

4. The watch of claim 3 wherein the watch module is depressible about a central module gimbal point and further comprising a module platform that supports the watch module at the central gimbal point so that straight-down depression of the watch module is prevented.

5. The watch of claim 3 wherein the switches are within the watch module and the watch module includes a plurality of apertures, one for each switch, and a plurality of pins, one for each switch, each pin secured to the base and extending through one of the apertures into the watch module for activating a switch when the watch module is depressed at a tactile portion.

6. The watch of claim 5 further comprising a plurality of O-rings, one for each aperture, disposed between each aperture and each switch pin.

7. The watch of claim 3 wherein the switches are disposed between the watch module and the base and the switches bias the watch module at a neutral position.

8. The watch of claim 3 further comprising a waterproof region surrounding for the switches.

9. The watch of claim 8 wherein the waterproof region is created by a flexible gasket having an inner bead held in place by the watch module and an outer bead held in place by the base.

10. The watch of claim 3 wherein the watch module includes a bottom opposite the display and the switches are disposed adjacent the bottom of the watch module; and further comprising a flexible seal enclosing the bottom of the watch module, the flexible seal having a biasing ring and a sealing lip, the sealing lip being connected to the watch module creating a waterproof region surrounding the switches and the biasing ring resiliently supporting the watch module.

11. The watch of claim 2 wherein the watch face is movably disposed over the watch module and the watch module is secured to the base.

12. The watch of claim 11 wherein the watch face is pivotal about a central face gimbal point and further comprising a face platform between the watch module and the watch face, the face platform being positioned so that straight-down depression of the watch face is prevented.

13. The watch of claim 11 further comprising an O-ring disposed between the base and the watch face creating a waterproof region surrounding the switches.

14. The watch of claim 11 wherein the watch face includes a skirt that overhangs the watch module, the skirt controlling the switches when the watch face is depressed.

15. The watch of claim 2 wherein depressing the watch face in between two of the tactile portions activates two of the switches simultaneously for activation of a secondary watch function.

16. The watch of claim 1 wherein the upper surface of the watch face defines a perimeter and further comprising a bumper surrounding the watch face along the perimeter of the watch face, the bumper being at least about as high as the tactile portions on the watch face.

17. The watch of claim 1 wherein the watch module delays before activating the watch functions in response to the switches.

18. The watch of claim 1 wherein the watch face is formed of a resilient, gel-like material and the switches are controlled by the watch face flowing in response to depressing the tactile portions.

19. A watch comprising:

a watch module having a display and a plurality of watch functions which the display can present;

a base supporting the watch module;

a watch face disposed over the display of the watch module, the watch face being centrally pivotal relative to the base;

a plurality of switches coupled to the watch module operable for activating the watch functions when the watch face is pressed by a wearer's finger.

20. A watch comprising:

a watch module having a display and a plurality of watch functions which the display can present;

a watch face disposed over the display of the watch module and having an upper surface defining a perimeter, the upper surface having a plurality of transparent, independently depressible portions;

a plurality of switches coupled to the watch module operable for activating the watch functions when the portions are depressed.

21. The watch of claim 19 wherein the functions displayed on the watch module are at least partly disposed beneath, and visible through, the portions.

22. A watch comprising:

a watch module having a display and a plurality of watch functions which the display can present;

a watch face disposed over the display of the watch module and having an upper surface defining a perimeter, the upper surface having a plurality of transparent, tactile portions;

a plurality of switches coupled to the watch module operable for activating the watch functions when the portions are depressed.

23. The watch of claim 21 wherein the functions displayed on the watch module are at least partly disposed beneath, and visible through, the tactile portions.

24. A controllable display device for presenting a plurality of informative functions, the device comprising:

a module having a display capable of being controlled to present the functions;

a face disposed over the module display and having an upper surface defining a perimeter, the upper surface having a plurality of transparent, tactile portions;

a plurality of switches coupled to the module operable for activating the functions when the portions are depressed.

25. A controllable display device for presenting a plurality of informative functions, the device comprising:

a module having a display capable of being controlled to present the functions;

a base supporting the module;

a transparent face with an upper surface, the face disposed over the display and centrally pivotal relative to the base;

a plurality of switches coupled to the display operable for controlling the functions when the face is pressed by a user's finger.

* * * * *